US010619340B2

(12) United States Patent
Cotter

(10) Patent No.: US 10,619,340 B2
(45) Date of Patent: Apr. 14, 2020

(54) INTERNAL TRAP DRAIN WITH ADJUSTABLE HEIGHT STRAINER AND HIGH MASS SEAL

(71) Applicant: Michael Joab Cotter, Ramona, CA (US)

(72) Inventor: Michael Joab Cotter, Ramona, CA (US)

( * ) Notice: Subject to any disclaimer, the term of this patent is extended or adjusted under 35 U.S.C. 154(b) by 317 days.

(21) Appl. No.: 15/627,395

(22) Filed: Jun. 19, 2017

(65) Prior Publication Data

US 2018/0016780 A1 Jan. 18, 2018

Related U.S. Application Data

(60) Provisional application No. 62/363,282, filed on Jul. 17, 2016.

(51) Int. Cl.
*E03F 5/04* (2006.01)
*E03F 5/042* (2006.01)

(52) U.S. Cl.
CPC ..... *E03F 5/0407* (2013.01); *E03F 5/042* (2013.01); *E03F 2005/0413* (2013.01); *E03F 2005/0416* (2013.01)

(58) Field of Classification Search
USPC ..... 4/288, 286; 210/163
See application file for complete search history.

(56) References Cited

U.S. PATENT DOCUMENTS 180,859 A * 8/1876 Falk ..... E03C 1/29 137/247.3
558,569 A * 4/1896 Sanders ..... E03C 1/284 137/247.3
873,120 A * 12/1907 Dunstan ..... E03C 1/29 137/247.35
1,411,125 A * 3/1922 O'Brien ..... E03F 5/0407 137/247.33
2,603,304 A * 7/1952 Carrier ..... E03F 5/0407 137/247.11
3,042,210 A * 7/1962 Hattori ..... E03F 5/0407 210/163
3,854,151 A * 12/1974 Boudewyn ..... E03F 5/0407 4/286
4,026,317 A * 5/1977 Ekstrom ..... E03C 1/29 137/216.1
4,487,219 A * 12/1984 Ma/ kela ..... E03C 1/29 137/362
4,910,811 A * 3/1990 Izzi, Sr. ..... E03C 1/262 210/163
4,922,948 A * 5/1990 Van Dijk ..... E03C 1/282 137/247.33
6,537,446 B1 * 3/2003 Sanguinetti ..... E03F 1/00 210/163
7,122,117 B1 * 10/2006 Goldring ..... E03F 5/0407 210/163
7,376,983 B1 * 5/2008 Sciarrino ..... E03C 1/264 4/288
7,735,512 B1 * 6/2010 Ismert ..... E03F 5/0407 137/362

(Continued)

*Primary Examiner* — Nina Bhat

(57) ABSTRACT

An internal trap drain with large volume/high mass water seal for improved absorption of pressure fluctuations and extended duration of seal against evaporation in low-use conditions. Includes adjustable height strainer and water seal-protected weep holes.

4 Claims, 3 Drawing Sheets

(56) References Cited

U.S. PATENT DOCUMENTS

| | | | | |
|---|---|---|---|---|
| 8,298,417 | B2 * | 10/2012 | Lemay | E03F 5/16 210/206 |
| 2006/0195976 | A1 * | 9/2006 | McAlpine | E03C 1/2306 4/287 |
| 2009/0100583 | A1 * | 4/2009 | You | E03C 1/262 4/287 |
| 2012/0036624 | A1 * | 2/2012 | Laera | A47K 1/14 4/295 |
| 2014/0101834 | A1 * | 4/2014 | Ball | E03C 1/26 4/286 |
| 2014/0289943 | A1 * | 10/2014 | Myers, II | E03C 1/26 4/288 |
| 2016/0032578 | A1 * | 2/2016 | Toms | E03F 5/0407 4/613 |
| 2016/0040411 | A1 * | 2/2016 | Carpenter-Crawford | E03C 1/0405 4/292 |
| 2016/0201307 | A1 * | 7/2016 | Franzen | E03C 1/2302 4/295 |

* cited by examiner

SECTION A - A

SECTION B - B

INTERNAL TRAP DRAIN WITH ADJUSTABLE HEIGHT STRAINER AND HIGH MASS SEAL

CROSS-REFERENCE TO RELATED APPLICATIONS

U.S. Pat. No. 180,859 October/1876 Falk . . . 137/216.1
U.S. Pat. No. 558,569 April/1896 Sanders . . . 137/247.35
U.S. Pat. No. 873,120 December/1907 Dunstan . . . 137/247.39
U.S. Pat. No. 1,411,125 March/1922 O'Brian . . . 137/247.33X
U.S. Pat. No. 2,603,304 July/1952 Carrier . . . 182/9
U.S. Pat. No. 3,042,210 July/1962 Hattori . . . 210/163
U.S. Pat. No. 4,026,317 May/1977 Ekstrom . . . 137/216.1, 247.39
U.S. Pat. No. 4,487,219 December/1984 Makela et al . . . 137/362
U.S. Pat. No. 4,922,948 May/1990 Van Dijk . . . 137/247
U.S. Pat. No. 7,122,117 October/2006 Goldring et al . . . 114/182

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

In steel shipbuilding, drains with internal trap, such as are shown in U.S. Pat. No. 558,569 by Sanders, U.S. Pat. No. 873,120 by Dunstan, U.S. Pat. No. 1,411,125 by O'Brian, U.S. Pat. No. 2,603,304 by Carrier, U.S. Pat. No. 3,042,210 by Hattori, U.S. Pat. No. 4,487,219 by Mäkelä et al, U.S. Pat. No. 4,922,948 by Van Dijk, and in particular U.S. Pat. No. 7,122,117 by Goldring et al are used because they are vertically more compact due to no p-trap requirement, and because these types of drains are more resistant to loss of trap seal resulting from listing of the ship. In U.S. Pat. No. 4,026,317, Ekstrom describes his trap drain as one which provides a "tortuous path" for the waste stream across multiple water seals, which each add resistance one to the next, resulting in greater absorption of pressure fluctuations while preserving seal integrity, as well as extending the time period in which an unused drain will lose seal due to evaporation. In U.S. Pat. No. 180,859 Falk talks about "widening and enlarging" the trap to oppose a larger volume of water to the sewer gases.

The aforementioned patents demonstrate the utility of the trap-in drain arrangement as well as the mechanism for reinforcing the trap seal through higher volume/mass of water against pressure fluctuations and as a means to increase trap seal endurance against evaporation. What is not found is a drain which incorporates trap-in-drain configuration along with adjustable height strainer and high-mass reinforced water seal.

BRIEF SUMMARY OF THE INVENTION

The present invention is an internal trap drain with strainer height adjustability and high-mass water seal incorporating more than twice as much volume of water as compared against a common p-trap.

BRIEF DESCRIPTION OF DRAWINGS

A more complete appreciation of the invention will be obtained as the same becomes better understood by reference to the following detailed description when considered in connection with the accompanying drawings wherein.

DETAILED DESCRIPTION OF THE INVENTION

Figure 1A:
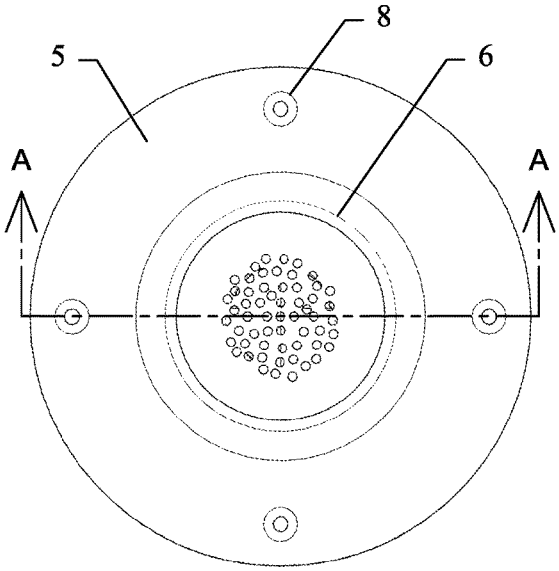
FIG. 1A shows a top plan view of the Internal Trap Drain with Adjustable Height Strainer and High Mass Seal with respect to the present invention.
Figure 2A:
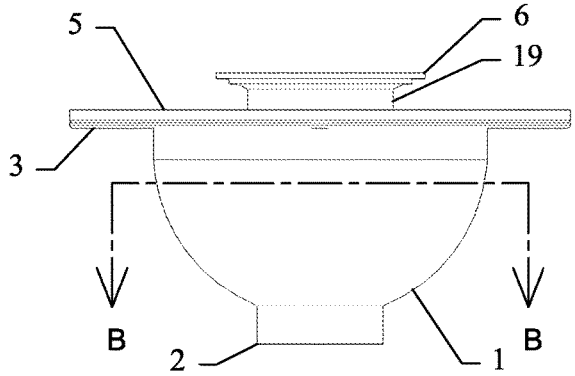
FIG. 2A shows a front elevation view of the Internal Trap Drain with Adjustable Height Strainer and High Mass Seal with respect to the present invention.
Figure 1B:
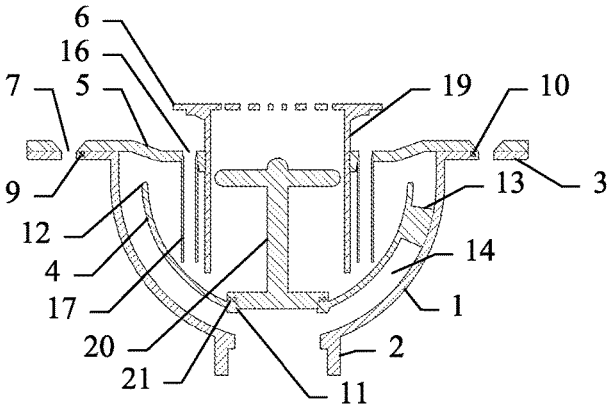
FIG. 1B shows a cross-sectional view of the Internal Trap Drain with Adjustable Height Strainer and High Mass Seal taken along line A-A of FIG. 1A with respect to the present invention.
Figure 2B:
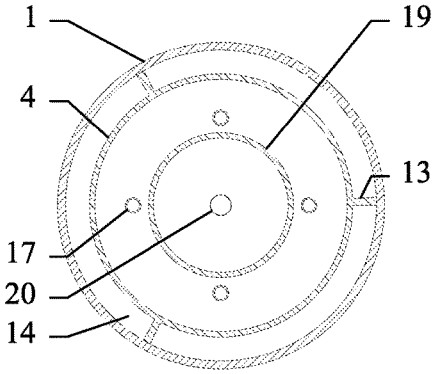
FIG. 2B shows a cross-sectional view of the Internal Trap Drain with Adjustable Height Strainer and High Mass Seal taken along line B-B of FIG. 2A with respect to the present invention.
Figure 3:
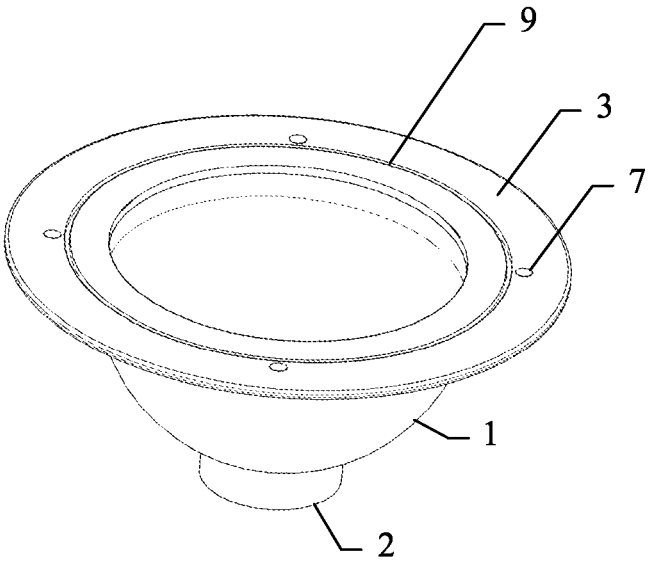
FIG. 3 shows a view of outer bowl 1, in which the top surface of flange 3 is visible with respect to the present invention.
Figure 4:
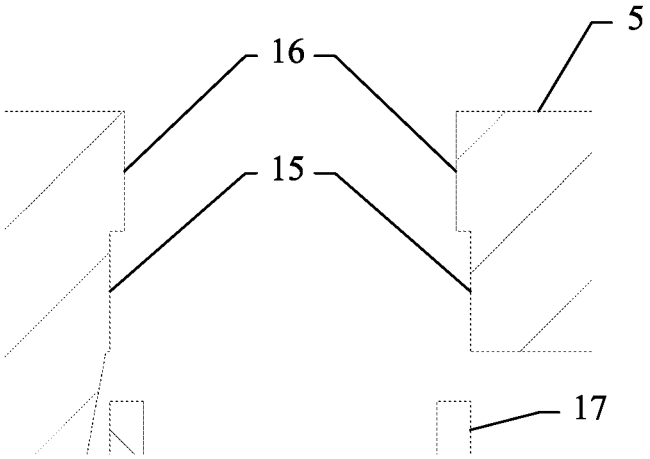
FIG. 4 is an enlarged view showing weep holes 16 and weep tube connection sockets 15 in top cover 5 of the Internal Trap Drain with Adjustable Height Strainer and High Mass Seal with respect to the present invention.
Figure 5:
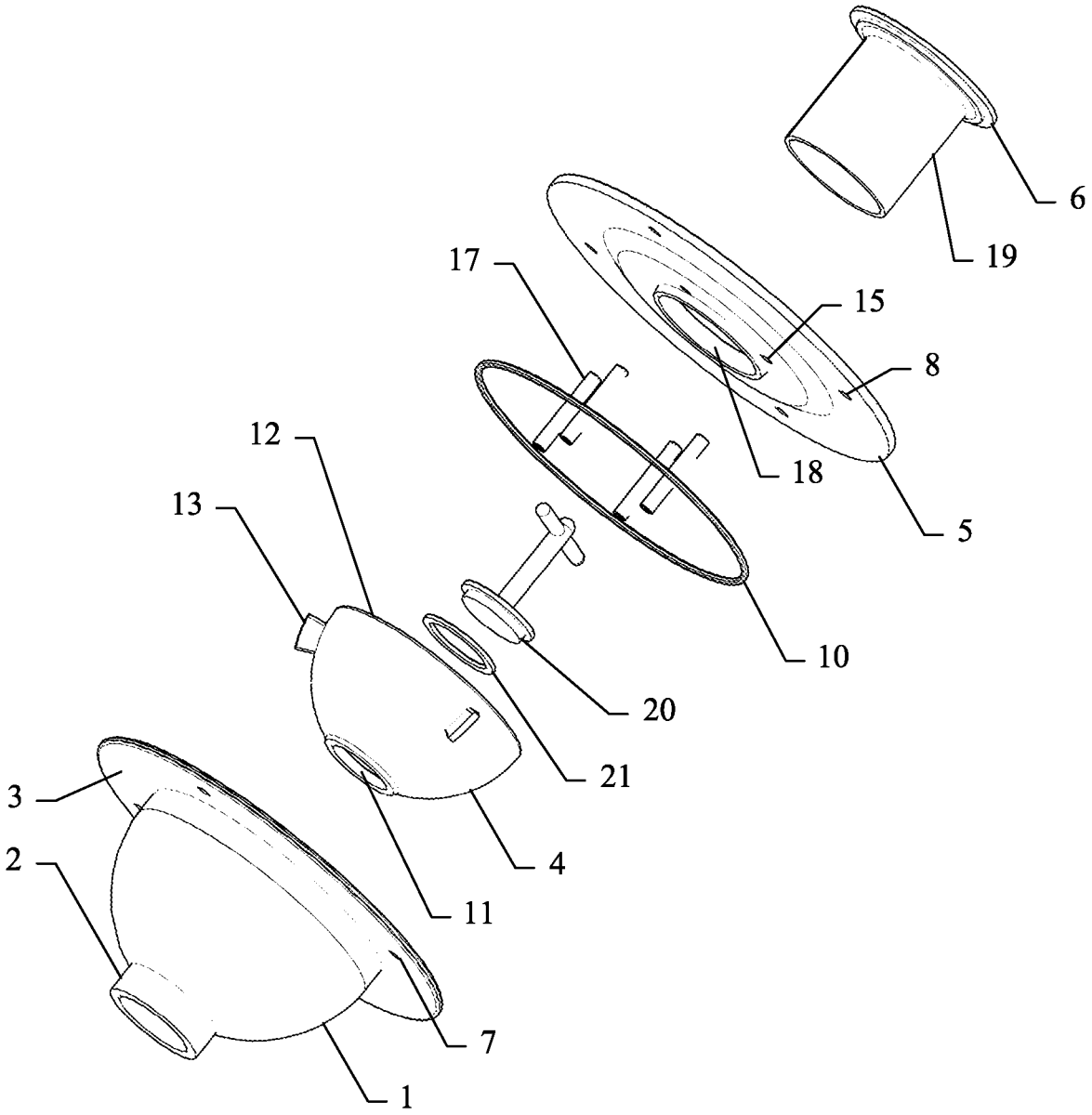
FIG. 5 is an exploded view of the Internal Trap Drain with Adjustable Height Strainer and High Mass Seal with respect to the present invention.

The drain is comprised of outer bowl 1, inner bowl 4, top cover 5, and strainer assembly 6. Outer bowl 1 has a piping connection 2 which serves as the drain outlet. Outer bowl 1 also has flange 3 which enables mounting the top cover through circumferentially located tapped holes 7 and corresponding countersunk through holes 8 in top cover 5 by means of flat head screws (not shown). In addition, flange 3-to-top cover 5 connection is sealed by gland 9 and O-ring 10.

Inner bowl 4 has threaded cleanout opening 11 at its base and polished spillway edge 12 at its upper perimeter. Three radially spaced supports 13 extend from the outside surface of inner bowl 4 and terminate in a curved shape which conforms to the interior surface of outer bowl 1.
Supports 13 maintain the position and attitude of inner bowl 4 as axially aligned with outer bowl 1 and maintain space 14 between the outside of inner bowl 4 and the inside of outer bowl 1. Upper edge 12 is polished to minimize solids accumulation as wastewater overflows edge 12 and flows through space 14 to drain opening 2.

In addition to through holes 8 for mounting and sealing to flange 3 of outer bowl 1, Top cover 5 has weep tube attachment sockets 15 which provide both weep holes 16 at the top surface of top cover 5 as well as connection sockets 15 for weep tubes 17, which extend down below the surface of the wastewater into inner bowl 4. Top cover 5 also has threaded hole 18 located at its center and threaded hole 18 is of the size and thread gauge to accommodate male threads 19 which form the exterior surface of the cylindrical portion of strainer assembly 6.

Threaded cleanout plug 20 along with rubber washer 21 is in place to close off threaded cleanout opening 11 in inner bowl 4, and is available for removal through the strainer assembly for cleanout when necessary.

As wastewater enters strainer assembly 6 it rises to edge 12 of inner bowl 4. Any additional water entering will cause a corresponding volume of water to spill over edge 12 and flow through space 14 to drain outlet 2. While the water level is at the height of edge 12, a water seal is established between the sewer gasses at the drain opening and strainer assembly 6 inlet. Weep holes 16 are also protected by the water seal. The gas cannot pass gland 9 and O-ring 10 and by applying thread sealant to male threads 19 the drain is rendered gas tight.

The invention claimed is:

1. An internal trap drain wherein the trap seal is formed by the interposition of an inner bowl filled with liquid and an externally-threaded adjustable height cylindrical strainer with axis perpendicular to the surface of said liquid and having a top end enclosed by strainer grid and a bottom end open and submerged below said surface and in which the adjustable strainer/seal is constructed and arranged to provide a large volume of liquid to create the seal and eliminate sewer gases thereby eliminating the need for the p-trap which conventional drains require; wherein the improvement comprises a high-volume, high mass seal to oppose sewer gases.

2. The internal trap drain of claim 1 in which an adjustable-height strainer is operably connected to the drain assembly; wherein the improvement comprises an adjustable-height strainer.

3. The internal trap drain of claim 1 in which a cleanout opening at the base of the inner bowl, a cleanout plug, and gasket to provide liquid-tight seal between said cleanout plug and said inner bowl are operatively connected to said inner bowl; wherein the improvement comprises the cleanout opening, cleanout plug and gasket.

4. The internal trap drain of claim 1 in which weep openings, said weep openings connected to weep tubes, said weep tubes comprising cylinders with the top end operatively connected to the weep openings in the top plate of the drain and the bottom end submerged below the surface of the liquid which fills the inner bowl are sealed to oppose sewer gas passage through the weep openings; wherein the improvement comprises liquid seal-protected weep holes with weep tubes.

* * * * *